US007740716B2

(12) United States Patent
Enokido et al.

(10) Patent No.: US 7,740,716 B2
(45) Date of Patent: Jun. 22, 2010

(54) RARE EARTH SINTERED MAGNET

(75) Inventors: Yasushi Enokido, Tokyo (JP); Gouichi Nishizawa, Tokyo (JP); Chikara Ishizaka, Tokyo (JP)

(73) Assignee: TDK Corporation, Chuo-Ku, Tokyo (JP)

( * ) Notice: Subject to any disclaimer, the term of this patent is extended or adjusted under 35 U.S.C. 154(b) by 525 days.

(21) Appl. No.: 11/576,050

(22) PCT Filed: Nov. 17, 2005

(86) PCT No.: PCT/JP2005/021083

§ 371 (c)(1),
(2), (4) Date: May 19, 2007

(87) PCT Pub. No.: WO2006/054617

PCT Pub. Date: May 26, 2006

(65) Prior Publication Data

US 2009/0178735 A1 Jul. 16, 2009

(30) Foreign Application Priority Data

Nov. 17, 2004 (JP) ..... 2004-333479

(51) Int. Cl.
*H01F 1/057* (2006.01)
*H01F 1/053* (2006.01)

(52) U.S. Cl. ..... 148/303; 148/301; 148/302; 75/244; 428/900

(58) Field of Classification Search ..... None
See application file for complete search history.

(56) References Cited

U.S. PATENT DOCUMENTS

| | | | | |
|---|---|---|---|---|
| 5,147,473 | A | 9/1992 | Ueda et al. | |
| 5,183,630 | A | 2/1993 | Ueda et al. | |
| 5,269,855 | A | 12/1993 | Ueda et al. | |
| 5,316,595 | A * | 5/1994 | Hamada et al. | 148/302 |
| 2004/0189426 | A1 | 9/2004 | Hidaka et al. | |
| 2005/0028892 | A1 * | 2/2005 | Sasaki | 148/302 |

FOREIGN PATENT DOCUMENTS

| | | | |
|---|---|---|---|
| JP | 7-66032 | A | 3/1995 |
| JP | 10-106819 | A | 4/1998 |

(Continued)

OTHER PUBLICATIONS

Machine Translation of Japanese Patent Publication 2004-253742.*

*Primary Examiner*—John P Sheehan
(74) *Attorney, Agent, or Firm*—Pearne & Gordon LLP

(57) ABSTRACT

The present invention provides a technique to improve an adhesion strength between a magnet main body and a protective film. The rare earth sintered magnet of the present invention comprises a magnet main body of a sintered body containing a rare earth element and a protective film formed on the magnet main body, wherein the ratio of a 10-point average surface roughness Rz of the magnet main body on which the protective film is formed to a mean grain size D50 in the magnet main body (Rz/D50 ratio) is kept in a range from 0.20 to 10.00, inclusive. This gives the rare earth sintered magnet which is coated with the protective film having a high adhesion strength of 100 N/m or more and exhibits high corrosion resistance.

8 Claims, 1 Drawing Sheet

FOREIGN PATENT DOCUMENTS

| | | | |
|---|---|---|---|
| JP | 11-97223 | A | 4/1999 |
| JP | 11-307328 | A | 11/1999 |
| JP | 2003-257721 | A | 9/2003 |
| JP | 2004-253742 | A | 9/2004 |
| JP | 2005-150572 | A | 6/2005 |

* cited by examiner

RARE EARTH SINTERED MAGNET

TECHNICAL FIELD

The present invention relates to a rare earth sintered magnet, represented by a Nd—Fe—B system permanent magnet, in particular a rare earth sintered magnet coated with a protective film.

BACKGROUND ART

Rare earth permanent magnets have been widely commercialized for their excellent magnetic properties. However, they contain a rare earth element and iron as main constituents, which are easily oxidized, and have relatively low corrosion resistance, so that their magnetic properties are deteriorated by oxidation. Therefore, their magnet main bodies are coated with a various protective film.

Patent Document 1, for example, discloses a permanent magnet comprising a magnet main body with surface irregularities, coated with an electroplated layer and an electrolessly plated layer. Patent Document 1 discusses that adhesion between the magnet main body and the plated layers formed thereon is improved by limiting its $R_{max}$ value (index of surface roughness, defined by JIS B-0610, according to the cited document 1) to a range from 3 to 50 μm.

Patent Document 2 discloses that a magnet main body can be coated with a protective film of high peel resistance, when it has a 10-point average surface roughness of 5 to 100 μm, defined by JIS B-0610, on the grounds that adhesion is insufficient at a roughness of 5 μm or less, and no improvement in adhesion is observed and product value is conversely deteriorated at 100 μm or more.

Patent Document 1: Japanese Patent Laid-Open No. 2-185004 (Claims, page 5)

Patent Document 2: Japanese Patent Laid-Open No. 7-66032 (Claims)

DISCLOSURE OF THE INVENTION

Patent Documents 1 and 2 propose that an adhesion strength between a magnet main body and a protective film can be improved by controlling a surface roughness of the uncoated magnet main body.

However, a rare earth permanent magnet is demanded to be coated with a protective film of higher adhesion strength, when it is pressed into a case for use, because it is subjected to a stress working so as to peel the protective film off from the magnet while it is being pressed into the case.

The present invention is developed to solve these technical problems. It is an object to provide a technique to improve an adhesion strength between the magnet main body and the protective film.

The present inventors have focused on the fact that in terms of a mechanism involved in adhesion of a protective film, bonding between the protective film and a magnet main body is based on physical bonding rather than chemical one, and that the adhesion strength of the protective film is determined not only by the surface roughness of the magnet main body on which it is formed but also by the size of grains on the interface between the protective film and the magnet main body. They have found that a rare earth sintered magnet with a protective film adhering thereto at a high adhesion strength and with a high corrosion resistance can be realized by controlling the ratio of the 10-point average surface roughness to the mean grain size of the sintered body in the magnet main body in a predetermined range.

The present invention provides a rare earth sintered magnet comprising a magnet main body of a sintered body containing a rare earth element and a protective film formed on the surface of the magnet main body, characterized in that the ratio of the 10-point average surface roughness (hereinafter referred to as "10-point average roughness Rz" or "Rz") of the magnet main body, on which the protective film is formed, to the mean grain size (hereinafter referred to as "grain size D50" or "D50") in the magnet main body is kept in a range from 0.20 to 10.00 inclusive, the ratio being hereinafter referred to as "Rz/D50." The grain size D50 is determined by image-processing of area of each grain present in the vicinity of interface between the magnet main body and the protective film, more specifically within a depth of about 100 μm from the interface. The procedure for determining the grain size D50 for the present invention will be described later in more detail in Examples, together with the procedure for determining the 10-point average roughness Rz.

The protective film is required to be sufficiently dense and defect-free to prevent permeation of oxygen, and, at the same time, to adhere to the rare earth sintered magnet surface at a high adhesion strength. The present invention, characterized by the Rz/D50 ratio within the above range, can have a high adhesion strength of 100 N/m or more, determined in accordance with JIS H-8504.

Keeping an Rz/D50 ratio in a range from 0.20 to 6.00, inclusive, can realize a rare earth sintered magnet coated with a protective film adhering thereto at a high adhesion strength and also high in corrosion resistance.

The type of protective film formed on the magnet main body is not limited, but preferably is formed by plating.

The present invention can provide a rare earth sintered magnet coated with a protective film strongly adhering to the surface without deteriorating magnet corrosion resistance.

BEST MODE FOR CARRYING OUT THE INVENTION

Figure 1:
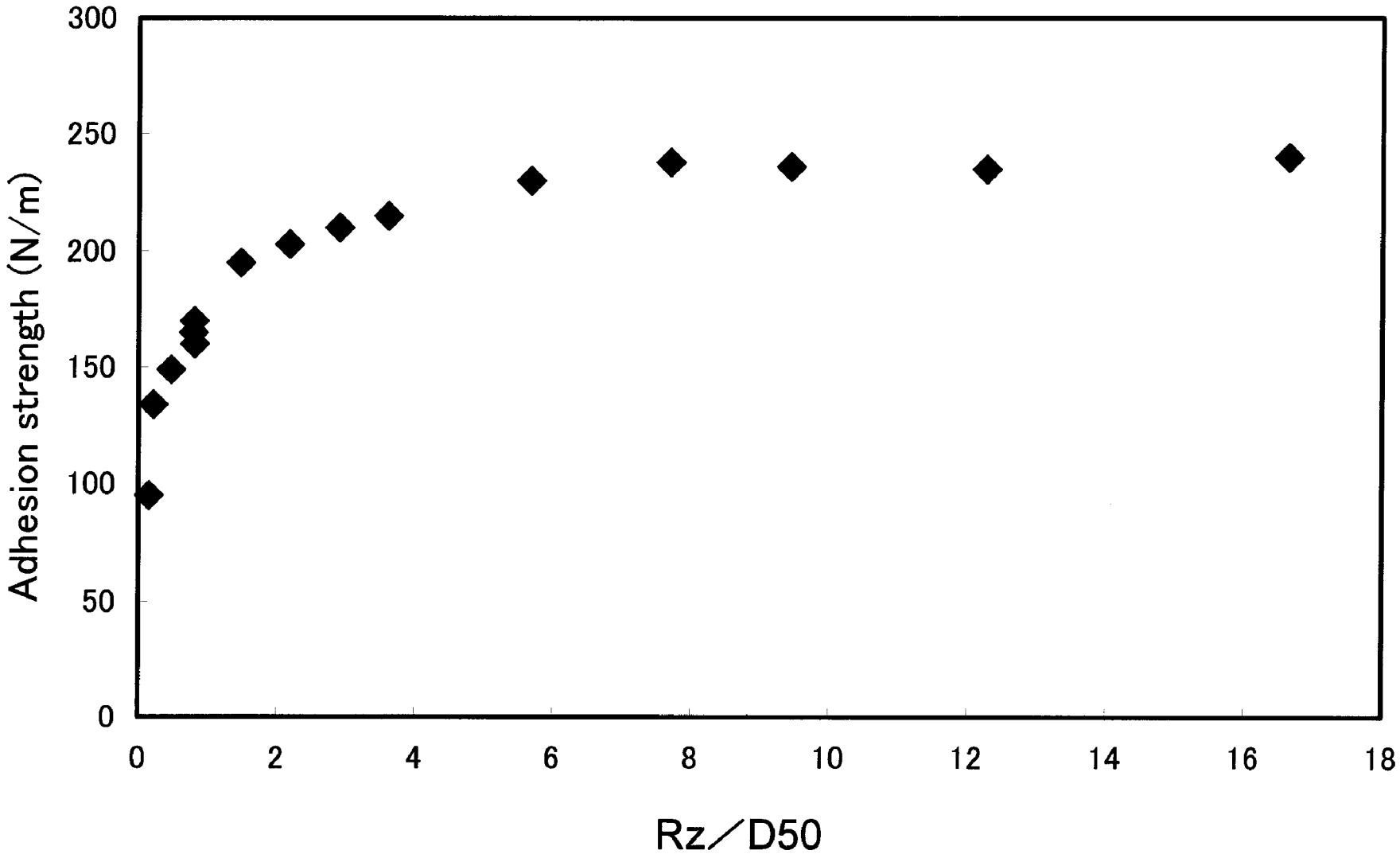
FIG. 1 is a graph illustrating the relationship between Rz/D50 ratio and adhesion strength.

The present invention is described in more detail below.

<Rare Earth Sintered Magnet>

First, the rare earth sintered magnet which the present invention is directed to is described.

The present invention is preferably applied to an R-T-B system sintered magnet, wherein R is one or more of rare earth elements, T is Fe or Fe and Co, and B is boron. It is because the R-T-B system sintered magnet is insufficient in corrosion resistance and will have to be coated with a protective film.

The R-T-B system sintered magnet contains a rare earth element (R) at 25 to 37 wt %, wherein R for the present invention has a concept which includes Y, R being one or more selected from among Y, La, Ce, Pr, Nd, Sm, Eu, Gd, Tb, Dy, Ho, Er, Tm, Yb and Lu. At an R content below 25 wt %, the R-T-B system sintered magnet may have a greatly deteriorated coercive force, because the $R_2T_{14}B$ phase as the main phase in the magnet is formed insufficiently, and α-Fe or the like showing soft magnetism separates out. At above 37 wt %, on the other hand, the magnet may have a deteriorated residual magnetic flux density, because of decreased volume ratio of the $R_2T_{14}B$ phase as the main phase in the magnet. At the same time, R will react with oxygen to increase oxygen content in the magnet, which can lead to deteriorated coercive force because of decreased content of the R-rich phase, which effectively creates coercive force. The R content is set at 25 to 37 wt %. It is preferably 28 to 35 wt %, more preferably 29 to 33 wt %.

Moreover, the R-T-B system sintered magnet to which the present invention is applied contains boron (B) at 0.5 to 4.5 wt %. At a B content below 0.5 wt %, the magnet may not have a sufficient coercive force. At above 4.5 wt %, on the other hand, the magnet tends to have a decreased residual magnetic flux density. Therefore, the upper limit of B content is set at 4.5 wt %. The B content is preferably 0.5 to 1.5 wt %, more preferably 0.8 to 1.2 wt %.

The R-T-B system sintered magnet to which the present invention is applied can contain Co at 3.0 wt % or less (excluding 0), preferably 0.1 to 2.0 wt %, more preferably 0.1 to 1.0 wt %, still more preferably 0.3 to 0.7 wt %. Co forms a phase similar to that formed by Fe, and is effective in increasing the Curie temperature and in improving the corrosion resistance of the grain boundaries.

The R-T-B system sintered magnet to which the present invention is applied can contain Al and/or Cu in a range of 0.02 to 0.5 wt %. The sintered magnet can have improved coercive force, corrosion resistance and temperature characteristics when it contains Al and/or Cu in the above range. Al, when used, is incorporated preferably at 0.03 to 0.3 wt %, more preferably 0.05 to 0.25 wt %. Cu, when used, is incorporated preferably at 0.15 wt % or less (excluding 0), more preferably 0.03 to 0.12 wt %.

The R-T-B system sintered magnet to which the present invention is applied may further contain other elements, e.g., Zr, Ti, Bi, Sn, Ga, Nb, Ta, Si, V, Ag, Ge and so forth. On the other hand, it is preferable to reduce impurity elements, e.g., oxygen, nitrogen, carbon and so forth, as far as possible. In particular, oxygen content is preferably limited to 5000 ppm or less, more preferably 3000 ppm or less, because oxygen has adverse effects on magnetic properties. At a higher oxygen content, the sintered magnet has an increased content of rare earth oxide phase(s) as non-magnetic component(s) to deteriorate its magnetic properties.

The present invention is preferably applied to an R-T-B system sintered magnet, but applicable to other types of rare earth sintered magnets, e.g., an R—Co system type.

The R—Co system sintered magnet contains R, one or more elements selected from among Fe, Ni, Mn and Cr, and Co. Preferably the magnet further contains Cu and one or more elements selected from among Nb, Zr, Ta, Hf, Ti and V, and particularly preferably contains Cu and one or more elements selected from among Nb, Zr, Ta, Hf, Ti and V. Of these, in particular, intermetallic compound of Sm and Co are present, preferably in the form of $Sm_2Co_{17}$ as a main phase and a $SmCo_5$ system auxiliary phase in the grain boundaries. A specific composition may be adequately selected depending on a production method adopted, required magnetic properties and so forth. However, the magnet preferably has a composition comprising R at 20 to 30%, in particular about 22 to 28%, one or more of Fe, Ni, Mn and Cr at about 1 to 35%, one or more of Nb, Zr, Ta, Hf, Ti and V at 0 to 6%, in particular about 0.5 to 4%, and Cu at 0 to 10%, in particular about 1 to 10%, the balance being of Co, all percentages by weight.

The R-T-B system and R—Co system sintered magnets have been described, which by no means limits application of the present invention to other types of rare earth sintered magnets.

A rare earth sintered magnet tends to have a coercive force increasing as its grain size (D50) decreases. Therefore, the grain size (D50) is set at 2.0 to 15.0 μm, preferably 10.0 μm or less, more preferably 2.5 to 8.0 μm, still more preferably 2.5 to 6.0 μm.

However, the grain size (D50) is 3.5 to 15.0 μm, more preferably 4.0 to 15.0 μm viewed from securing a high residual magnetic flux density.

<Protective Film>

The rare earth sintered magnet of the present invention comprises a rare earth sintered magnet main body coated with a protective film.

The protective film for the present invention is not limited, but particularly preferably formed by electrolytic plating. The electrolytic plating material may be selected from Ni, Ni—P, Cu, Zn, Cr, Sn or Al, of which Ni is more preferable although the other materials can be used. Moreover, these materials may be simultaneously used to form a multi-layered film. A protective film formed by electrolytic plating is a typical one for the present invention, but may be formed by another method. For example, any one of electroless plating, chemical treatment, e.g., chromate treatment, and coating with resin, or a combination thereof is a practical method. Thickness of the protective film should vary depending on size of the rare earth sintered magnet main body, required corrosion resistance level and so forth. However, it may be adequately set at 1 to 100 μm, preferably 1 to 50 μm, more preferably 1 to 20 μm.

<Relationship Between Grain Size D50 and 10-Point Average Roughnesses Rz>

Next, the relationship between the grain size D50 and the 10-point average roughness Rz as the most characteristic feature of the present invention is described.

In the present invention, the ratio of the 10-point average roughness Rz to the grain size D50 (Rz/D50 ratio) is set at 0.20 to 10.00, inclusive. At an Rz/D50 ratio below 0.20, the protective film may have an insufficient adhesion strength. At an Rz/D50 ratio above 10.00, on the other hand, the protective film may have pinholes excessively, which deteriorate film corrosion resistance because of accelerated corrosion on the magnet surface by water permeating the pinholes, although the film has a good adhesion strength. Moreover, the cost will be pushed up by additional extent of surface roughening to have an Rz/D50 ratio beyond 10.00.

The rare earth sintered magnet coated with the protective film can have an adhesion strength of 100 N/m or more while keeping desired corrosion resistance when it has an Rz/D50 ratio at 0.20 to 10.00, inclusive.

It should be noted, however, that the effect of improving adhesion strength of the protective film, brought by controlling the Rz/D50 ratio, tends to be saturated and, at the same time, film corrosion resistance starts to gradually decrease as the Rz/D50 ratio increases beyond 6.00. Therefore, the Rz/D50 ratio is preferably set at 0.20 to 6.00, inclusive, more preferably 0.50 to 6.00, inclusive, to simultaneously keep high protective film adhesion strength and corrosion resistance. An adhesion strength of 200 N/m or more can be secured at an Rz/D50 ratio of 2.00 to 6.00, inclusive.

When importance is placed on corrosion resistance, the Rz/D50 ratio is preferably set at 0.20 to 1.50, inclusive. Film corrosion resistance can be kept very high at an Rz/D50 ratio in the above range, preferably 0.50 to 1.00, inclusive, as discussed later in Examples.

It is necessary to set the 10-point average roughness Rz based on the grain size D50, as discussed above. However, corrosion resistance tends to deteriorate as the 10-point average roughness Rz increases beyond 40.0 μm, and it is preferably set at 20.0 μm or less, more preferably 1.5 to 20.0 μm, still more preferably 1.5 to 13.0 μm, when the grain size D50 is about 2.0 to 15.0 μm.

A magnet main body containing a rare earth element is generally fragile. However, the magnet main body for the present invention is coated with a protective film strongly adhering to the surface, so that the magnet main body is resistant to external forces.

A rare earth sintered magnet with a protective film may be pressed into a given void in a member, and a stress resulting from the pressing works to peel off the protective film. However, the protective film for the rare earth sintered magnet of the present invention has a sufficiently high adhesion strength of 100 N/m or more to keep its adhesion strength under the stress.

<Production Method>

The method suitably adopted for producing the R-T-B system sintered magnet of the present invention is described step by step.

The starting alloy can be produced by a strip casting process carried out under a vacuum or in an inert gas atmosphere, preferably an Ar atmosphere, or other known dissolution processes. A strip casting process sprays a starting metal melt, produced by dissolving the metal in a non-oxidative atmosphere, e.g., Ar atmosphere, onto a rotating roll. The melt quenched on the roll is rapidly solidified into thin plates or thin pieces (flaky pieces). The rapidly solidified alloy has a uniform structure having a grain size of 1 to 50 μm. The process is not limited to strip casting. The starting alloy can be also produced by other dissolution processes, e.g., radiofrequency induction dissolution. It can be solidified on a water-cooled copper plate positioned at an angle to prevent segregation of the molten alloy. Moreover, an alloy produced by reduction diffusion process can be used as the starting alloy.

For production of an R-T-B system sintered magnet, the so-called mixing process in which an alloy mainly composed of the $R_2T_{14}B$ grains (low-R alloy) is mixed with an alloy containing R at a higher content than the low-R alloy (high-R alloy) can be adopted for the present invention.

The starting alloy is then passed to a crushing step, where the low-R alloy and the high-R alloy, when a mixing process is adopted, may be crushed simultaneously or individually. The crushing step comprises a pulverizing step and a milling step. First, the starting alloy is pulverized to a grain size of several hundred microns preferably by a stamp mill, jaw crusher, Brown mill or the like in an inert gas atmosphere. It is an effective procedure to occlude the starting alloy with hydrogen for crushing prior to the pulverizing step. Hydrogen is released from the alloy later, because it works as an impurity for a rare earth sintered magnet and is released to minimize its content in the magnet. The alloy is kept at 200° C. or higher, preferably 350° C. or higher for the occlusion. Occlusion time varies depending on occlusion temperature adopted, starting alloy thickness and so forth, but is at least 30 minutes or more, preferably 1 hour or more. Hydrogen is released under a vacuum or in a flow of Ar gas. However, it is not essential to adopt occlusion with hydrogen followed by its release. When pulverizing using hydrogen is employed, mechanical pulverizing may be saved.

The pulverizing step is followed by a milling step, for which a jet mill is generally used to mill the pulverized powder of several hundred microns to a mean particle size of 1.5 to 11.5 μm, preferably 2.5 to 7 μm, more preferably 3 to 7 μm. A jet mill ejects an inert gas of high pressure out of a fine nozzle to generate a high-speed flow of the gas, by which the pulverized coarser powder particles are accelerated and collided with each other or with a target or container walls to divide them finely.

When a mixing process is adopted, timing for mixing 2 types of alloys is not limited. When the low-R and high-R alloys are milled individually at the milling step, the finely milled low-R and high-R alloy powders are mixed with each other in a nitrogen atmosphere. The low-R/high-R alloy powders mixing ratio may be about 80/20 to 97/3 by weight. The mixing ratio will be the same when they are milled at the same time. The alloy powders may be incorporated with an additive at about 0.01 to 0.3 wt % while being finely milled to improve their lubricity and orientation for a subsequent compacting step. The adequate additives include a fatty acid and derivative thereof, e.g., a stearate or oleate, more specifically zinc stearate, calcium stearate, aluminum stearate, amide stearate, amide oleate or amide ethylenebisisostearate; or a hydrocarbon, e.g., paraffin, naphthalene or the like.

The finely milled powders are then compacted into a predetermined shape. This step is a magnetic field compacting in which the powders are compacted in a magnetic field of a predetermined intensity.

Compacting pressure in the compacting in a magnetic field may be 0.3 to 3 tons/cm$^2$ (30 to 300 MPa). The compacting pressure may be constant throughout the step, or gradually increasing or decreasing, or changed irregularly. Decreasing the compacting pressure improves grain orientation, but gives a compact of insufficient strength to cause handling troubles when it is excessively low. In consideration of the above, the compacting pressure is set at a level in the above range. The compacted body produced by the compacting in a magnetic field generally has a final relative density of 50 to 60%.

Intensity of the magnetic field to be applied may be about 12 to 20 kOe (960 to 1600 kA/m). The magnetic field to be applied may be static, pulsed, or static and pulsed.

The resulting compacted body is then sintered under a vacuum or in an inert gas atmosphere. It is necessary to adjust sintering temperature in accordance with conditions, e.g., alloy composition, crushing process adopted, mean particle size, particle size distribution and so forth. However, the compacted body may be sintered at 1000 to 1200° C. for about 1 to 10 hours.

After the sintering, the resulting sintered body may be subjected to an aging treatment. This is an important step for controlling the coercive force of the sintered body. When the aging treatment is carried out in two stages, it is effective to control temperature at around 800° C. and then at around 600° C. for a predetermined time. Heat treatment of the sintered body at around 800° C. increases its coercive force, particularly effective when the mixing process is adopted. Heat treatment at around 600° C. greatly increases the coercive force of the sintered body, and it is recommended to adopt this temperature level when the aging treatment is carried out in one stage.

The treated sintered body is then cut into a predetermined shape having predetermined dimensions.

After the cutting, the sintered body is treated to control its surface roughness, before it is coated with a protective film. This treatment processes the sintered body to provide indentations/protrusions on the surface, thereby increasing adhesive strength of a protective film to be formed thereon. A desired surface roughness is set based on the grain size D50. More specifically, the surface roughness of the sintered body is controlled in such a way to keep the ratio of the 10-point average roughness Rz to the grain size D50 (Rz/D50 ratio) at 0.20 to 10.00, inclusive for the present invention, after the sintered body is coated with a protective film.

The method for processing the sintered body surface is not limited, but a mechanical processing is desired rather than a chemical one so that the magnetic properties are not damaged. The mechanical processing includes grinding with a grindstone, for example.

The sintered body, after having desired surface conditions, is coated with a protective film by a known method selected in consideration of protective film type. When electrolytic plating is adopted, the common procedure involves degreasing, washing with water, etching (e.g., with nitric acid), washing with water, electrolytic plating to form the film, washing with water and drying. The sintered body surface may be cleaned by degreasing and chemical etching with an acid.

Plating baths for electrolysis Ni plating useful for the present invention include a Watt bath containing no nickel chloride (solution is mainly composed of nickel sulfate and boric acid), sulfamic acid bath, borofluoride bath and nickel boride bath. In this case, the bath is preferably replenished with the nickel ion, preferably in the form of nickel sulfate or nickel boride solution, because of insufficient dissolution of the anode.

EXAMPLE 1

A starting alloy was prepared by strip casting to have a composition of Nd (26.5%)-Dy (5.9%)-Al (0.25%)-Co (0.5%)-Cu (0.07%)-B (1.0%)-Fe (balance), all percentages by weight.

The alloy was then occluded with hydrogen at room temperature and treated by hydrogen crushing at 600° C. for 1 hour in an Ar atmosphere to release hydrogen.

The alloy treated by hydrogen crushing was incorporated with a lubricant which worked to improve crushability and orientation in the compacting step at 0.05 to 0.1%. A Nauter mixer may be used for mixing the lubricant therewith for about 5 to 30 minutes. It was then finely milled by a jet mill under varying conditions to have milled powders of different particle size. Their sizes were determined by a laser diffraction particle size distribution analyzer. The results are given in Table 1.

The finely milled powders were compacted in a magnetic field having an intensity of 15 kOe (1200 kA/m) under a pressure of 1.4 tons/cm$^2$ (140 MPa).

The resulting compacted body was heated under a vacuum to 1080° C., at which it was held for 4 hours for sintering. It was then aging-treated in two stages, 800° C. for 1 hour and then 560° C. for 1 hour, both in an Ar atmosphere.

Sintered bodies of different grain sizes were obtained by sintering powders of different particle size under the same conditions. The sintered bodies were then ground with a grind stone to have different surface roughnesses. Each sintered body was then electrolytic plated with Ni to a thickness of 10 μm. The Ni-plated film (i.e., protective film) was measured for adhesion strength, in accordance with JIS H-8504.

The cross-section of the magnet coated with the Ni-plated protective film was observed to determine its grain size D50 and 10-points average roughness Rz by the following procedures, and based on the determined values the Rz/D50 ratio was calculated. The results are given in Table 1. FIG. 1 presents the relationship between the Rz/D50 ratio and the adhesion strength.

<Grain Size D50>

Photographs of the mirror-polished magnet cross-sections were taken by a polarization microscopy. From the photographs, each grain present in the vicinity of the interface between the magnet main body and the plated film (within a depth of 100 μm from the interface and in a 100 by 100 μm visual field) was image-processed to determine its area, from which its diameter was calculated by assuming that the grain was circular. The diameter, determined from the two-dimensional FIGURE, was multiplied by 1.5 to find a diameter in the three-dimensional spherical FIGURE corresponding to the circular FIGURE. This diameter of the sphere was defined as the grain size D50.

<10-Point Average Roughness Rz>

Photographs of the mirror-polished magnet cross-sections were taken by a polarization microscopy. The photograph was processed to trace the interface between the magnet main body and the plated film to produce a roughness curve, based on which the 10-point average roughness Rz was obtained in accordance with JIS-B0601.

Each sample was also evaluated for its corrosion resistance by a salt spray test in which the sample was immersed in a 5% aqueous NaCl solution kept at 35° C. for 240 hours. The results are given in Table 1, where the samples were evaluated according to the following standards:

○: Nothing abnormal detected

Δ: Partly rusted

X: Generally rusted

TABLE 1

| No. | Size of milled powders (μm) | Grain size of sintered body, D50 (μm) | 10-point average roughness Rz (μm) | Rz/D50 | Adhesion strength (N/m) | Salt spray test results (240 hours) | Salt spray test results (720 hours) |
|---|---|---|---|---|---|---|---|
| 1* | 5.6 | 7.3 | 1.1 | 0.15 | 95 | ○ | — |
| 2 | 5.7 | 7.4 | 1.6 | 0.22 | 134 | ○ | ○ |
| 3 | 5.9 | 7.6 | 3.6 | 0.47 | 149 | ○ | ○ |
| 4 | 5.7 | 7.4 | 5.9 | 0.80 | 165 | ○ | ○ |
| 5 | 10.7 | 13.6 | 11 | 0.81 | 170 | ○ | ○ |
| 6 | 3.2 | 4.3 | 3.5 | 0.81 | 160 | ○ | ○ |
| 7 | 3.3 | 4.4 | 6.5 | 1.48 | 195 | ○ | Δ |
| 8 | 5.6 | 7.2 | 15.7 | 2.18 | 203 | ○ | Δ |
| 9 | 4.0 | 5.2 | 15.1 | 2.90 | 210 | ○ | Δ |
| 10 | 3.1 | 4.1 | 14.8 | 3.61 | 215 | ○ | Δ |
| 11 | 2.3 | 3.1 | 17.6 | 5.68 | 230 | ○ | Δ |
| 12 | 2.4 | 3.3 | 25.4 | 7.70 | 238 | Δ | — |
| 13 | 2.4 | 3.2 | 30.2 | 9.44 | 236 | Δ | — |
| 14* | 2.4 | 3.3 | 40.5 | 12.27 | 235 | X | — |
| 15* | 3.2 | 4.2 | 69.9 | 16.64 | 240 | X | — |

*Comparative Examples

As shown in Table 1 and FIG. 1, there is a strong correlation between Rz/D50 ratio and adhesion strength; each of Sample nos. 2 to 15 having an Rz/D50 ratio of 0.20 or more has an adhesion strength of 100 N/m or more. An adhesion strength of 150 N/m or more can be secured at the ratio above 0.60.

It should be noted, however, that sintered magnet corrosion resistance starts to gradually decrease as the ratio increases beyond 6.00, and that it is generally rusted at the ratio above 10.00, as shown in Table 1. It is also noted, as shown in FIG. 1, that the effect of improving adhesion strength increases to a limited extent as the Rz/D50 ratio increases beyond 6.00. It can be concluded, based on these results, that the preferable Rz/D50 ratio is from 0.20 to 6.0, inclusive.

Sample nos. 2 to 11 were immersed in a 5% aqueous NaCl solution for additional 480 hours (total immersion time of 720 hours) to visually observe the changes of sintered magnet surfaces, in order to confirm the more preferable Rz/D50 range. Sample nos. 2 to 6 showed no change, whereas Sample nos. 7 to 11 were partly rusted, as shown in Table 1. Therefore, it was found that the sintered magnet has a still higher corrosion resistance when the Rz/D50 ratio is kept at 0.20 to 1.00.

Comparing the results of Sample no. 6 with those of Sample no. 10 having a similar D50 level, the latter was coated with the plated film less uniformly than the former having a 10-point average roughness of 3.5 μm, and partly rusted at the thinner film portions. The difference between them in formed plated film condition comes from difference in their 10-point average roughnesses. It is considered that Sample no. 10 is less corrosion-resistant, in spite of being coated with the film of higher adhesion strength, than Sample no. 6 because of its higher 10-point average roughness of about 15.0 μm. Sample nos. 8, 9 and 11 having a 10-point average roughness of 15.0 μm or more were on a level with Sample no. 10 in corrosion resistance. It is therefore concluded that keeping a 10-point average roughness of 13.0 μm or less, preferably 10.0 μm or less, is effective for securing high corrosion resistance.

EXAMPLE 2

A total of 9 types of samples similar to those prepared in Example 1 were subjected to a high temperature/high humidity test, where each was kept at 80° C. and relative humidity 90% for 480 hours, to observe rusted conditions on the surface. The results are given in Table 2, where the samples were evaluated according to the following standards:

○: Nothing abnormal detected

Δ: Partly rusted

X: Generally rusted

TABLE 2

| No. | Size of milled powders (μm) | Grain size of sintered body, D50 (μm) | 10-point average roughness Rz (μm) | Rz/D50 | Adhesion strength (N/m) | High temperature/ high humidity test results | Br(G) |
|---|---|---|---|---|---|---|---|
| 16 | 5.7 | 7.4 | 1.6 | 0.22 | 134 | ○ | 12755 |
| 17 | 5.9 | 7.6 | 3.6 | 0.47 | 149 | ○ | 12773 |
| 18 | 5.7 | 7.4 | 5.9 | 0.80 | 165 | ○ | 12759 |
| 19 | 10.7 | 13.6 | 11 | 0.81 | 170 | ○ | 12783 |
| 20 | 3.2 | 4.3 | 3.5 | 0.81 | 160 | ○ | 12749 |
| 21 | 3.3 | 4.4 | 6.5 | 1.48 | 195 | ○ | 12764 |
| 22 | 3.1 | 4.1 | 14.8 | 3.61 | 215 | Δ | 12735 |
| 23* | 2.4 | 3.3 | 40.5 | 12.27 | 235 | X | 12728 |
| 24* | 3.2 | 4.2 | 69.9 | 16.64 | 240 | X | 12736 |

*Comparative Examples

As shown in Table 2, Sample nos. 23 and 24 having an Rz/D50 ratio above 10.00 were generally rusted. By contrast, Sample nos. 16 to 22 having an Rz/D50 ratio in a range from 0.20 to 6.00 were rusted partly or showed no change on the sintered magnet surfaces.

Sample nos. 16 to 24 were measured for residual magnetic flux density (Br) using a B—H tracer. As shown in Table 2, Sample nos. 16 to 22 showing good high temperature/high humidity test results had a higher residual magnetic flux density (Br) than Sample nos. 23 and 24. In particular, Sample nos. 18 to 21 having an Rz/D50 ratio in a range from 0.50 to 1.50 had an adhesion strength of 150 N/m or more and, at the same time, residual magnetic flux density (Br) of 12,740 G or more. Sample nos. 18, 19 and 20 had a similar Rz/D50 ratio, although D50 and Rz levels of one sample were much different from those of another. These results confirm that it is important to control the Rz/D50 ratio in order to secure high corrosion resistance and magnetic properties simultaneously.

The invention claimed is:

1. A rare earth sintered magnet comprising a magnet main body of a sintered body containing a rare earth element and a protective film formed on the magnet main body, characterized in that the ratio of a 10-point average surface roughness Rz of the magnet main body on which the protective film is formed to a mean grain size D50 in the magnet main body (Rz/D50 ratio) is in a range from 0.20 to 0.81 inclusive, the D50 is 2.0 to 15.0 μm, and the Rz is 1.5 to 11 μm, the rare earth sintered magnet is an R-T-B system sintered magnet, and the protective film has an adhesion strength of 100 N/m or more.

2. The rare earth sintered magnet according to claim 1, characterized in that the protective film is formed by plating.

3. The rare earth sintered magnet according to claim 2, characterized in that the protective film is formed by electrolytic plating.

4. The rare earth sintered magnet according to claim 2, characterized in that the protective film comprises Ni.

5. The rare earth sintered magnet according to claim 3, characterized in that the protective film comprises Ni.

6. The rare earth sintered magnet according to claim 1, 2, 3, 4 or 5, characterized in that the R-T-B system sintered magnet comprises 25 to 37 wt % of R, 0.5 to 4.5 wt % of B and 0.02 to 0.5 wt % of one or both of Al and Cu, the balance being substantially T, wherein a is one or more rare earth elements, T is Fe or Fe and Co, and B is boron.

7. The rare earth sintered magnet according to claim 1, 2, 3, 4 or 5, characterized in that the D50 is 2.5 to 8.0 μm.

8. The rare earth sintered magnet according to claim 6, characterized in that the D50 is 2.5 to 8.0 μm.

* * * * *